US011994117B2

(12) United States Patent
Susca et al.

(10) Patent No.: US 11,994,117 B2
(45) Date of Patent: May 28, 2024

(54) VARIABLE POSITIVE DISPLACEMENT PUMP ACTUATOR SYSTEMS

(71) Applicant: Hamilton Sundstrand Corporation, Charlotte, NC (US)

(72) Inventors: Ryan Susca, Windsor, CT (US); Morgan O'Rorke, West Hartford, CT (US); Ryan Shook, Rockford, IL (US); Matej Rutar, Manchester, CT (US)

(73) Assignee: Hamilton Sundstrand Corporation, Charlotte, NC (US)

( * ) Notice: Subject to any disclaimer, the term of this patent is extended or adjusted under 35 U.S.C. 154(b) by 171 days.

(21) Appl. No.: 17/493,390

(22) Filed: Oct. 4, 2021

(65) Prior Publication Data

US 2023/0105578 A1 Apr. 6, 2023

(51) Int. Cl.

| | |
|---|---|
| ***F04B 1/34*** | (2006.01) |
| ***F04B 49/00*** | (2006.01) |
| *F04B 49/12* | (2006.01) |

(52) U.S. Cl.
CPC ..... *F04B 1/34* (2013.01); *F04B 49/002* (2013.01); *F04B 49/12* (2013.01)

(58) Field of Classification Search
CPC ..... F04B 1/34; F04B 49/002; F04B 49/12; F04C 2240/811
See application file for complete search history.

(56) References Cited

U.S. PATENT DOCUMENTS 3,429,225 A * 2/1969 Keyworth ..... F15B 9/09 137/83
3,478,513 A 11/1969 Carlton et al.
(Continued)

FOREIGN PATENT DOCUMENTS

WO 00/16464 A2 3/2000

OTHER PUBLICATIONS

Extended European Search Report issued by the European Patent Office, dated Jan. 27, 2023, in corresponding European Patent Application No. 22199338.9.

*Primary Examiner* — Thomas Fink

(57) ABSTRACT

A variable positive displacement pump actuator system for a variable positive displacement pump can include a supply line configured to provide a supply pressure, a main pump line configured to provide a pump pressure greater than the supply pressure from the variable positive displacement pump, and at least one electro-hydraulic servo valve (EHSV) in fluid communication with the supply line and the main pump line to receive the supply pressure and the pump pressure. The at least one electro-hydraulic servo valve can be configured to output a first regulated pressure and a second regulated pressure. The system can include a first control line in fluid communication with at least one of the at least one EHSV to receive the first controlled pressure, a second control line in fluid communication with at least one of the at least one EHSV to receive the second controlled pressure, a first hydraulic actuator configured to connect to and/or otherwise actuate a lever arm of the variable positive displacement pump, the first hydraulic actuator in fluid communication with the first control line and the supply line to receive the first control pressure and the supply pressure to control a position of the first hydraulic actuator, and a second hydraulic actuator configured to connect to and/or otherwise actuate the lever arm of the variable positive displacement pump, the second hydraulic actuator in fluid communication with the second control line and the supply line to receive the second control pressure and the supply pressure to control a position of the second hydraulic actuator.

18 Claims, 1 Drawing Sheet

(56) References Cited

U.S. PATENT DOCUMENTS

| | | | | |
|---|---|---|---|---|
| 3,510,231 | A * | 5/1970 | Bobst | F04B 49/08 417/218 |
| 3,861,832 | A * | 1/1975 | Pinson | F04B 49/002 60/444 |
| 4,205,590 | A | 6/1980 | Stegner | |
| 4,722,186 | A * | 2/1988 | Louis | F04B 49/002 60/426 |
| 6,053,707 | A * | 4/2000 | Itsuji | F04B 49/065 417/20 |
| 6,102,001 | A | 8/2000 | McLevige | |
| 6,298,661 | B1 * | 10/2001 | Holder | F16H 61/423 60/451 |
| 7,726,951 | B2 | 6/2010 | Jansen et al. | |
| 9,234,464 | B2 | 1/2016 | Benson | |
| 10,233,950 | B2 * | 3/2019 | Bitter | E02F 9/2296 |
| 10,969,035 | B2 | 4/2021 | Williams et al. | |
| 2002/0095933 | A1 * | 7/2002 | Takada | F16H 61/40 60/487 |
| 2002/0176784 | A1 | 11/2002 | Du | |
| 2003/0115867 | A1 * | 6/2003 | Takada | F16H 61/4131 60/487 |
| 2005/0100464 | A1 * | 5/2005 | Maruyama | F04B 49/24 417/63 |
| 2007/0017219 | A1 * | 1/2007 | Niidome | F04B 49/002 60/444 |
| 2013/0085647 | A1 * | 4/2013 | Lister | B60W 30/18054 701/55 |
| 2013/0224044 | A1 | 8/2013 | Maruoka et al. | |
| 2015/0000513 | A1 * | 1/2015 | Funasaka | F04B 1/122 91/505 |
| 2016/0341223 | A1 * | 11/2016 | Marsch | F04B 1/34 |

* cited by examiner

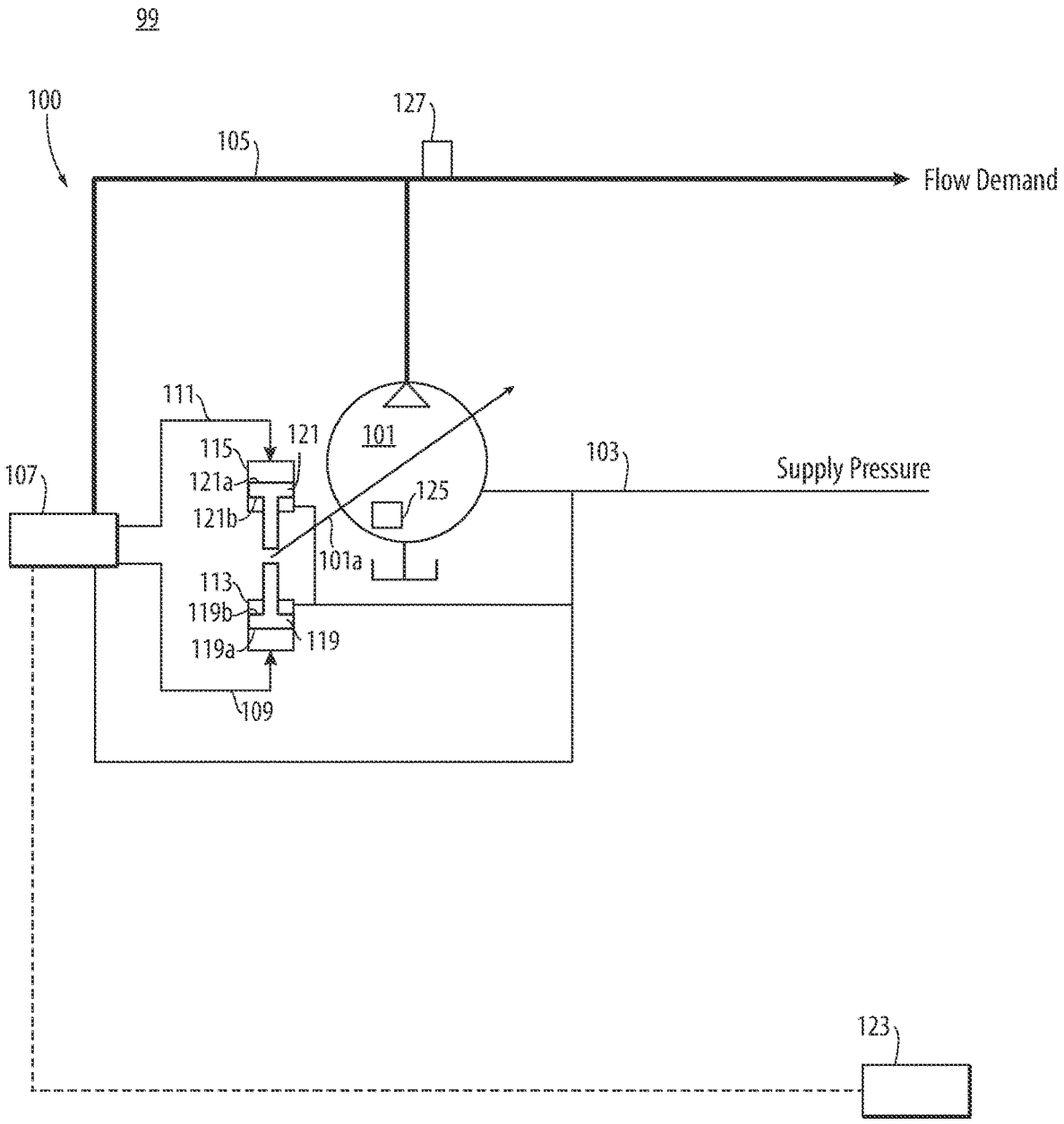
99
100
105
127
Flow Demand
111
115
121
121a
121b
101
103
Supply Pressure
107
125
101a
113
119b
119a
119
109
123

VARIABLE POSITIVE DISPLACEMENT PUMP ACTUATOR SYSTEMS

STATEMENT OF GOVERNMENT RIGHTS

This invention was made with government support awarded by the United States Air Force. The government has certain rights in the invention.

FIELD

This disclosure relates to variable positive displacement pumps (e.g., piston pumps).

BACKGROUND

Most variable displacement pumps have a single actuator acting against a spring for adjusting pump displacement during operation. These actuators have asymmetric areas, which causes nonlinear performance (e.g., such that they extend faster/retract slower or vice versa). The actuator load capability is limited by the rod side with the reduced area. Also, the single actuator gives directed control in one direction only, and while control in the other direction can be regulated, the force from the spring is a fixed constant.

Such conventional methods and systems have generally been considered satisfactory for their intended purpose. However, there is still a need in the art for improved actuator systems. The present disclosure provides a solution for this need.

SUMMARY

A variable positive displacement pump actuator system for a variable positive displacement pump can include a supply line configured to provide a supply pressure, a main pump line configured to provide a pump pressure greater than the supply pressure from the variable positive displacement pump, and at least one electro-hydraulic servo valve (EHSV) in fluid communication with the supply line and the main pump line to receive the supply pressure and the pump pressure. The at least one electro-hydraulic servo valve can be configured to output a first regulated pressure and a second regulated pressure. The system can include a first control line in fluid communication with at least one of the at least one EHSV to receive the first controlled pressure, a second control line in fluid communication with at least one of the at least one EHSV to receive the second controlled pressure, a first hydraulic actuator configured to connect to and/or otherwise actuate a lever arm of the variable positive displacement pump, the first hydraulic actuator in fluid communication with the first control line and the supply line to receive the first control pressure and the supply pressure to control a position of the first hydraulic actuator, and a second hydraulic actuator configured to connect to and/or otherwise actuate the lever arm of the variable positive displacement pump, the second hydraulic actuator in fluid communication with the second control line and the supply line to receive the second control pressure and the supply pressure to control a position of the second hydraulic actuator.

In certain embodiments, the at least one EHSV can be a single EHSV in fluid communication with both the first control line and the second control line. Any suitable number of EHSVs in any suitable communication with either or both of the first control line or second control line are contemplated herein.

The first hydraulic actuator can include a first piston configured to connect to the lever arm. The first control line can be in fluid communication with a first side of the first piston, and the supply line can be in fluid communication with a second side of the first piston such that a differential pressure between the first control line and the supply line causes motion of the first piston.

The second hydraulic actuator can include a second piston configured to connect to the lever arm. The second control line can be in fluid communication with a first side of the second piston, and the supply line can be in fluid communication with a second side of the second piston such that a differential pressure between the second control line and the supply line causes motion of the second piston.

The first piston and the second piston can be opposing such that when the first controlled pressure is higher than the second controlled pressure, the first piston pushes against the second piston, and such that when the second controlled pressure is higher than the first controlled pressure, the second piston pushes against the first piston. Any other suitable arrangement is contemplated herein.

In certain embodiments, the system can include a control module configured to control the EHSV to cause a desired lever arm position and/or pump output. The control module can include any suitable hardware and/or software modules configured to perform any suitable function (e.g., as disclosed herein).

In certain embodiments, the control module can be an electronic engine controller (EEC), or is in communication with the EEC. Any other suitable device (e.g., an aircraft system controller) is contemplated herein.

In certain embodiments, the system can include a linear variable differential transducer (LVDT) attached to one or both of the first and second hydraulic actuators, and/or directly to the lever arm, the LVDT in operative communication with the control module to provide signals indicative of lever arm position to the control module. For example, the control module can be configured to control the position of the first and second hydraulic actuators to position the lever arm to a desired position.

In certain embodiments, the system can include one or more flow measurement devices disposed on the main pump line and configured to measure main pump flow and/or pressure, the one or more flow measurement devices configured in operative communication with the control module to provide signals indicative of the main pump flow and/or pressure to the control module. For example, the control module can be configured to control the position of the first and second hydraulic actuators to achieve a desired main pump flow and/or pressure.

In certain embodiments, the variable positive displacement pump can be a piston pump. Any other suitable type of positive displacement pump (e.g., with a lever arm displacement control) is contemplated herein.

In accordance with at least one aspect of this disclosure, a pump system can include a variable positive displacement pump having a lever arm configured to control a displacement of the variable positive displacement pump. The pump system can also include a variable positive displacement pump actuator system operatively connected to the lever arm of the variable positive displacement pump. The variable positive displacement pump actuator system can be or include any suitable embodiment of an actuator system disclosed herein (e.g., as described above).

In accordance with this disclosure, a method can include controlling a lever arm position of a piston variable positive displacement pump using an electro-hydraulic servo valve (EHSV). In certain embodiments, controlling the lever arm position can include controlling a position of a pair of actuators connected to the lever arm using the EHSV. The method can include any suitable other method(s) and/or portion(s) thereof.

A variable positive displacement pump actuator system for a variable positive displacement pump can include a supply line configured to provide a supply pressure, a main pump line configured to provide a pump pressure greater than the supply pressure from the variable positive displacement pump, and at least one control valve in fluid communication with the supply line and the main pump line to receive the supply pressure and the pump pressure. The at least one control valve can be configured to output a first regulated pressure and a second regulated pressure. The system can also include a first control line in fluid communication with at least one of the at least one control valve to receive the first controlled pressure, a second control line in fluid communication with at least one of the at least one control valve to receive the second controlled pressure, a first hydraulic actuator configured to connect to and/or otherwise actuate a lever arm of the variable positive displacement pump, the first hydraulic actuator in fluid communication with the first control line and the supply line to receive the first control pressure and the supply pressure to control a position of the first hydraulic actuator, and a second hydraulic actuator configured to connect to and/or otherwise actuate the lever arm of the variable positive displacement pump, the second hydraulic actuator in fluid communication with the second control line and the supply line to receive the second control pressure and the supply pressure to control a position of the second hydraulic actuator. In certain embodiments, the control valve can be hydromechanically controlled.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein:

FIG. 1 is a schematic diagram of an embodiment of an actuator system and pump system in accordance with this disclosure.

DETAILED DESCRIPTION

Reference will now be made to the drawings wherein like reference numerals identify similar structural features or aspects of the subject disclosure. For purposes of explanation and illustration, and not limitation, an illustrative view of an embodiment of a system in accordance with the disclosure is shown in FIG. 1 and is designated generally by reference character 100. Certain embodiments described herein can be used to control positive displacement pumps, e.g., for aircraft fuel systems, for example.

In accordance with one or more aspects of this disclosure, referring to FIG. 1, a variable positive displacement pump actuator system 100 for a variable positive displacement pump 101 can include a supply line 103 configured to provide a supply pressure, a main pump line 105 configured to provide a pump pressure greater than the supply pressure from the variable positive displacement pump 101, and at least one electro-hydraulic servo valve (EHSV) 107 in fluid communication with the supply line 103 and the main pump line 105 to receive the supply pressure and the pump pressure.

The at least one EHSV 107 can be configured to output a first regulated pressure and a second regulated pressure, for example. The system 100 can include a first control line 109 in fluid communication with at least one of the at least one EHSV 107 to receive the first controlled pressure. The system 100 can also include a second control line 111 in fluid communication with at least one of the at least one EHSV 107 (e.g., the same EHSV 107 that the first control line 109 is connected to) to receive the second controlled pressure.

The system 100 can include a first hydraulic actuator 113 configured to connect to and/or otherwise actuate a lever arm 101*a* of the variable positive displacement pump 101. The first hydraulic actuator 113 can be in fluid communication with the first control line 109 and the supply line 103 (e.g., as shown) to receive the first control pressure and the supply pressure to control a position of the first hydraulic actuator 113.

The system 100 can also include a second hydraulic actuator 115 configured to connect to and/or otherwise actuate the lever arm 101*a* of the variable positive displacement pump 101. The second hydraulic actuator 115 can be in fluid communication with the second control line 111 and the supply line 103 to receive the second control pressure and the supply pressure to control a position of the second hydraulic actuator 115.

In certain embodiments, the at least one EHSV 107 can be a single EHSV 107 (e.g., as shown) in fluid communication with both the first control line 109 and the second control line 111. Any suitable number of EHSVs in any suitable communication with either or both of the first control line 109 or second control line 111 are contemplated herein.

The first hydraulic actuator 113 can include a first piston 119 configured to connect to the lever arm 101*a*. The first control line 109 can be in fluid communication with a first side 119*a* of the first piston 119, and the supply line 103 can be in fluid communication with a second side 119*b* of the first piston 119 such that a differential pressure between the first control line 111 and the supply line 103 causes motion of the first piston 119. In certain embodiments, the first side 119*a* can have a larger surface area than the second side 119*b*, e.g., as shown.

The second hydraulic actuator 115 can include a second piston 121 configured to connect to the lever arm 101*a*. The second control line 111 can be in fluid communication with a first side 121*a* of the second piston 121, and the supply line 103 can be in fluid communication with a second side 121*b* of the second piston 121 such that a differential pressure between the second control line 111 and the supply line 103 causes motion of the second piston 121. In certain embodiments, the first side 121*a* can have a larger surface area than the second side 121*b*, e.g., as shown.

As shown in FIG. 1, the first piston 119 and the second piston 121 can be opposing such that when the first controlled pressure is higher than the second controlled pressure, the first piston 119 pushes against the second piston 121, and such that when the second controlled pressure is higher than the first controlled pressure, the second piston 121 pushes against the first piston 119. Any other suitable arrangement is contemplated herein.

In certain embodiments, the system 100 can include a control module 123 operatively connected to the EHSV 107 and configured to control the EHSV 107 to cause a desired lever arm position and/or pump output. The control module 123 can include any suitable hardware and/or software modules configured to perform any suitable function (e.g., as disclosed herein).

In certain embodiments, the control module 123 can be an electronic engine controller (EEC), e.g., as shown, or can be in communication with the EEC. Any other suitable device (e.g., an aircraft system controller) is contemplated herein. In certain embodiments, the control module 123 and/or the EHSV 107 can be configured to bias the actuators 113, 115 to a maximum flow position in the event of a control module failure or EHSV failure.

In certain embodiments, the system 100 can include a linear variable differential transducer (LVDT) 125 attached to one or both of the first and second hydraulic actuators 113, 115, and/or directly to the lever arm 101*a* (e.g., as shown). The LVDT 125 can be in operative communication with the control module 123 to provide signals indicative of lever arm position to the control module 123. For example, the control module 123 can be configured to control the position of the first and second hydraulic actuators 113, 115 to position the lever arm 123 to a desired position (e.g., which can be correlated to a predetermined flow value and/or engine speed).

In certain embodiments, the system 100 can include one or more flow measurement devices 127 disposed on the main pump line 105 and configured to measure main pump flow and/or pressure. The one or more flow measurement devices 127 can be configured to be in operative communication with the control module 123 to provide signals indicative of the main pump flow and/or pressure to the control module 123. For example, the control module 123 can be configured to control the position of the first and second hydraulic actuators 113, 115 to achieve a desired main pump flow and/or pressure (e.g., by reading feedback from the one or more sensors 127 and changing position until a certain flow/pressure is reached).

In certain embodiments, the variable positive displacement pump 101 can be a piston pump. Any other suitable type of positive displacement pump (e.g., with a lever arm displacement control) is contemplated herein.

In accordance with at least one aspect of this disclosure, a pump system 99 can include a variable positive displacement pump 101 having a lever arm 101*a* configured to control a displacement of the variable positive displacement pump 101 (e.g., as a function of position of the lever arm 101*a*). The pump system 99 can also include a variable positive displacement pump actuator system, e.g., system 100, operatively connected to the lever arm 101*a* of the variable positive displacement pump 101. The variable positive displacement pump actuator system can be or include any suitable embodiment of an actuator system disclosed herein (e.g., actuator system 100 as described above).

In accordance with this disclosure, a method can include controlling a lever arm, e.g., lever arm 101*a*, of a position of a piston variable positive displacement pump, e.g., pump 101, using an electro-hydraulic servo valve (EHSV), e.g., valve 107. In certain embodiments, controlling the lever arm position can include controlling a position of a pair of actuators 113, 115 connected to the lever arm 101*a* using the EHSV 107. The method can include any suitable other method(s) and/or portion(s) thereof.

A variable positive displacement pump actuator system for a variable positive displacement pump can include a supply line configured to provide a supply pressure, a main pump line configured to provide a pump pressure greater than the supply pressure from the variable positive displacement pump, and at least one control valve in fluid communication with the supply line and the main pump line to receive the supply pressure and the pump pressure. The system can include at least one control valve (e.g., a hydromechanical valve, an EHSV, or any other suitable valve type) can be configured to output a first regulated pressure and a second regulated pressure. The system can also include a first control line in fluid communication with at least one of the at least one control valve to receive the first controlled pressure, a second control line in fluid communication with at least one of the at least one control valve to receive the second controlled pressure, a first hydraulic actuator configured to connect to and/or otherwise actuate a lever arm of the variable positive displacement pump, the first hydraulic actuator in fluid communication with the first control line and the supply line to receive the first control pressure and the supply pressure to control a position of the first hydraulic actuator, and a second hydraulic actuator configured to connect to and/or otherwise actuate the lever arm of the variable positive displacement pump, the second hydraulic actuator in fluid communication with the second control line and the supply line to receive the second control pressure and the supply pressure to control a position of the second hydraulic actuator. In certain embodiments, the control valve can be hydromechanically controlled. For example, the control pressures delivered to each actuator can be regulated by a control valve that responds to the system (e.g., the supply pressure and/or the main pump pressure and/or a mechanical control setting).

Embodiments can utilize an EHSV (or other suitable control valve) to create a pressure somewhere at or between main pump pressure and a lower supply pressure on a plurality of control lines. This can be a function of current supplied to the EHSV. In a steady state mode pressures in the plurality of control lines may be equal so that no motion occurs.

Embodiments can provide a very accurately controlled slew rate in both directions of actuation of the lever arm. Traditional devices can only operate quickly in one direction. In certain embodiments, the EHSV can be designed to fail in a way that there is a pressure differential output to the control lines so that the lever arm moves in a desired way (e.g., to the max flow condition). In embodiments, the supply pressure can be from a boost pump or tank pump, e.g., a centrifugal pump and can be always lower than the control pressure and the main pump pressure.

Embodiments can provide a double acting variable displacement piston pump actuator. Embodiments can replace a spring in traditional devices with a second actuator. The second actuator can be colinear with the first actuator, or coplanar, or in any other suitable arrangement relative to the first actuator. The two actuators can be plumbed such that an EHSV (linked to pump output and input pressures) can modulate pressure to a larger piston diameter on both actuators to create a balanced system such that one actuator becomes the extend actuator, and the other the retract actuator. The small area of each actuator piston can be plumbed to pump inlet pressure. Pump lever arm position can be monitored by an LVDT attached to one or both actuators, directly to the pump displacement linkage, or via a downstream measurement device (flowmeter, flow sensing valve, etc).

Embodiments can provide a load holding, slew rate, and response that can be identical in both directions, e.g., where each actuator is single acting. By utilizing the actuators in concert, the slew rate and response capabilities can be tailored to the operational needs of the actuation system. The diameter and/or other size of the actuators can shrink such that there is a near net zero weight change, yet the actuators can still have a comparable or better performance of previously larger sized single actuators.

As will be appreciated by those skilled in the art, aspects of the present disclosure may be embodied as a system, method or computer program product. Accordingly, aspects of this disclosure may take the form of an entirely hardware embodiment, an entirely software embodiment (including firmware, resident software, micro-code, etc.), or an embodiment combining software and hardware aspects, all possibilities of which can be referred to herein as a "circuit," "module," or "system." A "circuit," "module," or "system" can include one or more portions of one or more separate physical hardware and/or software components that can together perform the disclosed function of the "circuit," "module," or "system", or a "circuit," "module," or "system" can be a single self-contained unit (e.g., of hardware and/or software). Furthermore, aspects of this disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of this disclosure may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of this disclosure may be described above with reference to flowchart illustrations and/or block diagrams of methods, apparatus (systems) and computer program products according to embodiments of this disclosure. It will be understood that each block of any flowchart illustrations and/or block diagrams, and combinations of blocks in any flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in any flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified herein.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A variable positive displacement pump actuator system for a variable positive displacement pump, comprising:

a supply line configured to provide a supply pressure;

a main pump line configured to provide a pump pressure greater than the supply pressure from the variable positive displacement pump;

at least one electro-hydraulic servo valve (EHSV) in fluid communication with the supply line and the main pump line to receive the supply pressure and the pump pressure, the at least one electro-hydraulic servo valve configured to output a first regulated pressure and a second regulated pressure;

a first control line in fluid communication with at least one of the at least one EHSV to receive the first controlled pressure;

a second control line in fluid communication with at least one of the at least one EHSV to receive the second controlled pressure, wherein the at least one EHSV is a single EHSV in fluid communication with both the first control line and the second control line;

a first hydraulic actuator configured to connect to and/or otherwise actuate a lever arm of the variable positive displacement pump, the first hydraulic actuator in fluid communication with the first control line and the supply line to receive the first control pressure and the supply pressure to control a position of the first hydraulic actuator, wherein the first hydraulic actuator includes a first piston configured to connect to the lever arm, wherein the first control line is in fluid communication with a first side of the first piston, and the supply line is in fluid communication with a second side of the first piston such that a differential pressure between the first control line and the supply line causes motion of the first piston; and a second hydraulic actuator configured to connect to and/or otherwise actuate the lever arm of the variable positive displacement pump, the second hydraulic actuator in fluid communication with the second control line and the supply line to receive the second control pressure and the supply pressure to control a position of the second hydraulic actuator.

2. The system of claim 1, wherein the second hydraulic actuator includes a second piston configured to connect to the lever arm, wherein the second control line is in fluid communication with a first side of the second piston, and the supply line is in fluid communication with a second side of the second piston such that a differential pressure between the second control line and the supply line causes motion of the second piston.

3. The system of claim 2, wherein the first piston and the second piston are opposing such that when the first controlled pressure is higher than the second controlled pressure, the first piston pushes against the second piston, and such that when the second controlled pressure is higher than the first controlled pressure, the second piston pushes against the first piston.

4. The system of claim 1, further comprising a control module configured to control the EHSV to cause a desired lever arm position and/or pump output.

5. The system of claim 4, wherein the control module is an electronic engine controller (EEC), or is in communication with the EEC.

6. The system of claim 4, further comprising a linear variable differential transducer (LVDT) attached to one or both of the first and second hydraulic actuators, and/or directly to the lever arm, the LVDT in operative communication with the control module to provide signals indicative of lever arm position to the control module, wherein the control module is configured to control the position of the first and second hydraulic actuators to position the lever arm to a desired position.

7. The system of claim 4, further comprising one or more flow measurement devices disposed on the main pump line and configured to measure main pump flow and/or pressure, the one or more flow measurement devices configured in operative communication with the control module to provide signals indicative of the main pump flow and/or pressure to the control module, wherein the control module is configured to control the position of the first and second hydraulic actuators to achieve a desired main pump flow and/or pressure.

8. The system of claim 1, wherein the variable positive displacement pump is a piston pump.

9. A pump system, comprising:

a variable positive displacement pump having a lever arm configured to control a displacement of the variable positive displacement pump; and a variable positive displacement pump actuator system operatively connected to the lever arm of the variable positive displacement pump, comprising:

a supply line configured to provide a supply pressure;

a main pump line configured to provide a pump pressure greater than the supply pressure from the variable positive displacement pump;

at least one electro-hydraulic servo valve (EHSV) in fluid communication with the supply line and the main pump line to receive the supply pressure and the pump pressure, the at least one electro-hydraulic servo valve configured to output a first regulated pressure and a second regulated pressure;

a first control line in fluid communication with at least one of the at least one EHSV to receive the first controlled pressure;

a second control line in fluid communication with at least one of the at least one EHSV to receive the second controlled pressure, wherein the at least one EHSV is a single EHSV in fluid communication with both the first control line and the second control line;

a first hydraulic actuator configured to connect to and/or otherwise actuate a lever arm of the variable positive displacement pump, the first hydraulic actuator in fluid communication with the first control line and the supply line to receive the first control pressure and the supply pressure to control a position of the first hydraulic actuator, wherein the first hydraulic actuator includes a first piston connected to the lever arm, wherein the first control line is in fluid communication with a first side of the first piston, and the supply line is in fluid communication with a second side of the first piston such that a differential pressure between the first control line and the supply line causes motion of the first piston; and a second hydraulic actuator configured to connect to and/or otherwise actuate the lever arm of the variable positive displacement pump, the second hydraulic actuator in fluid communication with the second control line and the supply line to receive the second control pressure and the supply pressure to control a position of the second hydraulic actuator.

10. The pump system of claim 9, wherein the second hydraulic actuator includes a second piston connected to the lever arm, wherein the second control line is in fluid communication with a first side of the second piston, and the supply line is in fluid communication with a second side of the second piston such that a differential pressure between the second control line and the supply line causes motion of the second piston.

11. The pump system of claim 10, wherein the first piston and the second piston are opposing such that when the first controlled pressure is higher than the second controlled pressure, the first piston pushes against the second piston, and such that when the second controlled pressure is higher than the first controlled pressure, the second piston pushes against the first piston.

12. The pump system of claim 9, further comprising a control module configured to control the EHSV to cause a desired lever arm position and/or pump output.

13. The pump system of claim 12, wherein the control module is an electronic engine controller (EEC), or is in communication with the EEC.

14. The pump system of claim 12, further comprising a linear variable differential transducer (LVDT) attached to one or both of the first and second hydraulic actuators, and/or directly to the lever arm, the LVDT in operative communication with the control module to provide signals indicative of lever arm position to the control module, wherein the control module is configured to control the position of the first and second hydraulic actuators to position the lever arm to a desired position.

15. The pump system of claim 12, further comprising one or more flow measurement devices disposed on the main pump line downstream of the variable positive displacement pump and configured to measure main pump flow and/or pressure, the one or more flow measurement devices configured in operative communication with the control module to provide signals indicative of the main pump flow and/or pressure to the control module, wherein the control module is configured to control the position of the first and second hydraulic actuators to achieve a desired main pump flow and/or pressure.

16. A variable positive displacement pump actuator system for a variable positive displacement pump, comprising:

a supply line configured to provide a supply pressure;

a main pump line configured to provide a pump pressure greater than the supply pressure from the variable positive displacement pump;

at least one control valve in fluid communication with the supply line and the main pump line to receive the supply pressure and the pump pressure, the at least one control valve configured to output a first regulated pressure and a second regulated pressure;

a first control line in fluid communication with at least one of the at least one control valve to receive the first controlled pressure;

a second control line in fluid communication with at least one of the at least one control valve to receive the second controlled pressure;

a first hydraulic actuator configured to connect to and/or otherwise actuate a lever arm of the variable positive displacement pump, the first hydraulic actuator in fluid communication with the first control line and the supply line to receive the first control pressure and the supply pressure to control a position of the first hydraulic actuator, wherein the first hydraulic actuator includes a first piston configured to connect to the lever arm, wherein the first control line is in fluid communication with a first side of the first piston, and the supply line is in fluid communication with a second side of the first piston such that a differential pressure between the first control line and the supply line causes motion of the first piston; and a second hydraulic actuator configured to connect to and/or otherwise actuate the lever arm of the variable positive displacement pump, the second hydraulic actuator in fluid communication with the second control line and the supply line to receive the second control pressure and the supply pressure to control a position of the second hydraulic actuator.

17. The system of claim 16, wherein the first hydraulic actuator includes a first piston configured to connect to the lever arm, wherein the first control line is in fluid communication with a first side of the first piston, and the supply line is in fluid communication with a second side of the first piston such that a differential pressure between the first control line and the supply line causes motion of the first piston.

18. The system of claim 16, wherein the at least one EHSV is a single EHSV in fluid communication with both the first control line and the second control line.

* * * * *